US005596193A

United States Patent [19]

Chutjian et al.

[11] Patent Number: 5,596,193

[45] Date of Patent: Jan. 21, 1997

[54] MINIATURE QUADRUPOLE MASS SPECTROMETER ARRAY

[75] Inventors: Ara Chutjian, La Crescenta; Michael H. Hecht, Los Angeles; Otto J. Orient, Glendale, all of Calif.

[73] Assignee: California Institute of Technology, Pasadena, Calif.

[21] Appl. No.: 540,817

[22] Filed: Oct. 11, 1995

[51] Int. Cl.[6] ..... H01J 49/42

[52] U.S. Cl. ..... 250/292; 250/281

[58] Field of Search ..... 250/292, 281

[56] References Cited

U.S. PATENT DOCUMENTS

| | | | |
|---|---|---|---|
| 2,939,952 | 6/1960 | Paul et al. | 250/292 |
| 3,075,076 | 1/1963 | Gunther | 250/292 |
| 3,143,647 | 8/1964 | Gunther et al. | 250/292 |
| 3,939,344 | 2/1976 | McKinney | 250/292 |
| 4,481,415 | 11/1984 | Takeda et al. | 250/292 |
| 5,401,962 | 3/1995 | Ferran | 250/292 |

OTHER PUBLICATIONS

Fairbairn, The Review of Scientific Instruments, vol. 40, No. 2, Feb. 1969, pp. 380–381.

"Das elektrische Massenfilter als Massenspektrometer und Isotopentrenner," by W. Paul, H. P. Reinhard and U. von Zahn; Zeitschrift fur Physik, Bd. 152, S. 143–192 (1958). No Month.

"Introducing the Micropole Sensor For Affordable Gas Analysis," Ferran Scientific (Catalog); San Diego, California; Oct., 1992, and insert (4 pages).

"Towards the Miniaturization of Mass, Velocity and Energy Analyzers," by S. Boumsellek, A. Chutjian, F. J. Grunthanner, M. H. Hecht, K. E. Martus, O. J. Orient, R. E. Stalder and G. E. Voecks; Jet Propulsion Laboratory Publication No. JPL D–10852; Jun., 1993.

*Primary Examiner*—Jack I. Berman

*Attorney, Agent, or Firm*— Michaelson & Wallace

[57] ABSTRACT

The present invention provides a minature quadrupole mass spectrometer array for the separation of ions, comprising a first pair of parallel, planar, nonmagnetic conducting rods each having an axis of symmetry, a second pair of planar, nonmagnetic conducting rods each having an axis of symmetry parallel to said first pair of rods and disposed such that a line perpendicular to each of said first axes of symmetry and a line perpendicular to each of said second axes of symmetry bisect each other and form a generally 90 degree angle. A nonconductive top positioning plate is positioned generally perpendicular to the first and second pairs of rods and has an aperture for ion entrance along an axis equidistant from each axis of symmetry of each of the parallel rods, a nonconductive bottom positioning plate is generally parallel to the top positioning plate and has an aperture for ion exit centered on an axis equidistant from each axis of symmetry of each of the parallel rods, means for maintaining a direct current voltage between the first and second pairs of rods, and means for applying a radio frequency voltage to the first and second pairs of rods.

23 Claims, 5 Drawing Sheets

MINIATURE QUADRUPOLE MASS SPECTROMETER ARRAY

ORIGIN OF INVENTION

The invention described herein was made in the performance of work under a NASA contract, and is subject to the provisions of Public Law 96-517 (35 USC 202) in which the Contractor has elected to retain title.

BACKGROUND OF THE INVENTION

1. Technical Field

The present invention relates to an improved quadrupole mass spectrometer array for the separation of ions with different masses.

2. Background Art

The quadrupole mass spectrometer ("QMS") was first proposed by W. Paul (1958). In general, the QMS separates ions with different masses by applying a direct current ("dc") voltage and a radio frequency ("rf") voltage on four rods having hyperbolic or circular cross sections and an axis equidistant from each rod. Opposite rods have identical potentials. The electric potential in the quadrupole is a quadratic function of the coordinates.

Ions are introduced in a longitudinal direction through a circular entrance aperture at the ends of the rods and centered on a midpoint between rods. Ions are deflected by the field depending on the ratio of the ion mass to the charge of the ion ("mass/charge ratio") and, by selecting the applied voltage and the amplitude and frequency of the rf signal, only ions of a selected mass/charge ratio exit the QMS along the axis of a quadrupole at the opposite end and are detected. Ions having other mass/charge ratios either impact the rods and are neutralized or deflected away from the axis of the quadrupole. As explained in Boumsellek, et al. (1993), a solution of Mathieu's differential equations of motion in the case of round rods provides that to select ions with a mass m, using an rf signal of frequency f and rods separated by a distance $R_o$, the peak rf voltage $V_o$ and dc voltage $U_o$ should be as follows:

$$V_o=7.219\ m\ f^2\ R_o^2$$

$$U_o=1.212\ m\ f^2\ R_o^2$$

Conventional QMSs weigh several kilograms, have volumes of the order of $10^2$ $cm^3$, and require 10–100 watts of power. Further, vacua in the range of $10^{-6}$–$10^{10}$ torr are needed for satisfactory signal-to-noise ratio, due to the large free mean path required to transverse the pole length. Commercial QMSs of this design have been used for characterizing trace components in the atmosphere (environmental monitoring), in automobile exhausts, thin film manufacture, plasma processing, and explosives/controlled-substances detection. Such conventional QMSs are not suitable, however, for spacecraft life support-support systems and certain national defense missions where they have the disadvantages of relatively large mass, volume, and power requirements.

To meet these needs, a miniature QMS was developed by Ferran Scientific, Inc. (San Diego, Calif.). The Ferran QMS uses a miniature array of sixteen rods comprising nine individual quadrupoles. The rods are supported only at the detector end of the QMS by means of powdered glass that is heated and cooled to form a solid support structure. The dc and rf electric potentials are applied by the use of springs contacting the rods. The Ferran QMS dimensions are approximately 2 cm diameter by 5 cm long, including a gas ionizer and detector, with an estimated mass of 100 grams. The reduced size of the Ferran QMS results in several advantages, including a reduced power consumption of approximately 10 watts and the ability to operate at a higher operating pressure of approximately 1 mTorr.

The Ferran QMS was analyzed by Boumsellek, et al. (1993) and it was determined that its resolution was approximately 2.5 amu in the mass range 1–95 amu. This is a relatively low resolution for a QMS, making the miniature Ferran QMS only useful for commercial processing (e.g. chemical-vapor deposition, blood-plasma monitoring), but not for applications that require accurate mass separation, such as spacecraft life-support systems. The low resolution was traced to the fact that the rods were aligned only to within a 2% accuracy, whereas an alignment accuracy in the range of 0.1% is necessary for a high resolution QMS (Boumsellek et al. 1993). In addition, the ratio of rod radius to one-half the distance between rods having the same polarity (the "kissing circle" radius) of the Ferran QMS was measured to be about 1.46, whereas the ideal ratio is 1.16 (Boumsellek et al. 1993). It is these and other disadvantages of the Ferran QMS that the present invention overcomes.

SUMMARY OF THE INVENTION

The quadrupole mass spectrometer array ("QMSA") of the present invention retains the size, weight, vacuum operating conditions and power consumption advantages of the Ferran QMS, while significantly improving its resolution for measurements of ion mass. A QMSA according to the invention comprises a first pair of parallel, planar, nonmagnetic conducting rods each having an axis of symmetry, a second pair of planar, nonmagnetic conducting rods each having an axis of symmetry parallel to said first pair of rods and disposed such that a line perpendicular to each of said first axes of symmetry and a line perpendicular to each of said second axes of symmetry bisect each other and form a generally 90 degree angle. A nonconductive top positioning plate is positioned generally perpendicular to the pairs of rods and has an aperture for ion entrance along an axis equidistant from each axis of symmetry of each of the parallel rods, a nonconductive bottom positioning plate is generally parallel to the top positioning plate and has an aperture for ion exit centered on an axis equidistant from each axis of symmetry of each of the parallel rods, means for maintaining a direct current voltage difference between the first and second pairs of rods, and means for applying a radio frequency voltage to said first and second pairs of rods.

DETAILED DESCRIPTION OF THE PREFERRED EMBODIMENT

Figure 1:
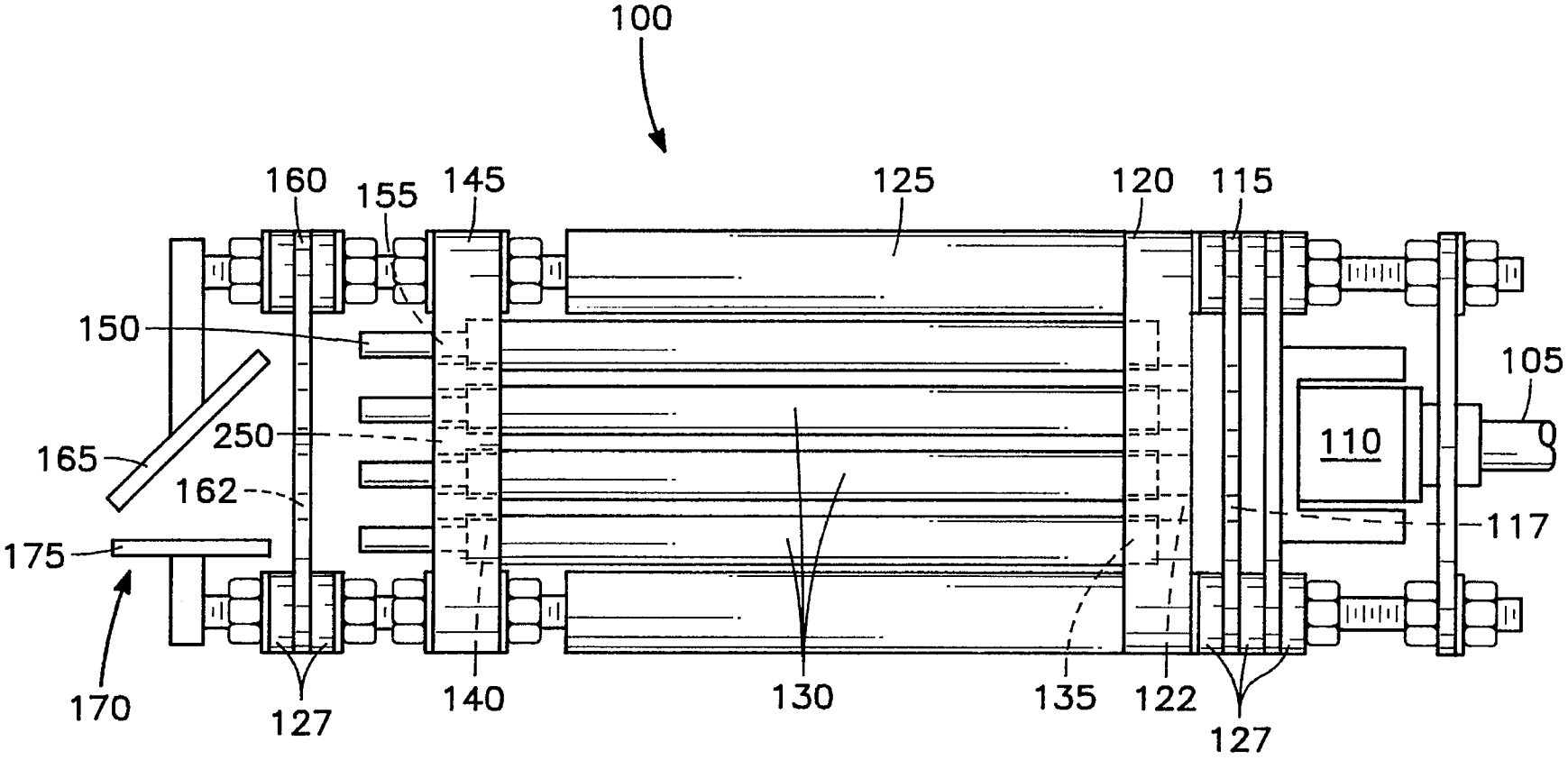
FIG. 1 is a cross section view of a QMSA according to the present invention.

A QMSA 100 of the present invention is shown in FIG. 1. A gas inlet 105 is attached to the entrance aperture of an ionizer chamber 110. An electrode 115 is positioned adjacent to the exit aperture of the ionizer chamber 110, preferably at a distance of approximately 0.1 cm. Apertures 117 are formed in the electrode 115 and aligned with the axis of each quadrupole, which is defined by a line equidistant from each axis of symmetry of each rod of the quadrupole.

A top retainer plate 120 is aligned adjacent to the electrode 115, preferably at a distance of approximately 0.1 cm. The retainer plate 120 may be made of any insulator capable of being precisely machined, such as a glass or ceramic, and a preferred material is Macor made by Corning Glass, Corning, N.Y. Apertures 122 aligned with the axis of each quadrupole are formed in the top retainer plate 120. Support rods 125, made of nonmagnetic stainless steel, titanium, or other nonmagnetic metal, are positioned flush against the top retainer plate 120. Sleeved insulator rings 127, made of Macor, ceramic or other insulating material, separate the electrode 115 and chamber 110 from the support rods 125. Although four support rods 125 are shown in FIG. 1, any suitable number may be used as described later.

The ion entrance ends of quadrupole rods 130 are fitted into top positioning cavities 135 formed in the top retainer plate 120. The rods 130 are parallel to each other and aligned such that a first and second pair are each planar. In addition, each rod 130 of a first pair is equidistant from each rod 130 of the second pair and the distance between the axes of symmetry of each rod 130 of the first pair is equal to the distance between the axes of symmetry of each rod 130 of the second pair. Based on the equations explained in Boumsellek, et al. (1993), a preferred length of the rods 130 is no greater than approximately 2.000 cm and a preferred radius is no greater than approximately 0.100 cm. Further, the ratio between the rod 130 radius and the "kissing circle" radius is approximately 1.16. The quadrupole rods 130 may be made of any nonmagnetic, corrosion-resistant conductor, such as stainless steel (S/S 304 or 316), tungsten, molybdenum or titanium. Although sixteen quadrupole rods 130 comprising nine quadrupoles are shown in FIG. 1, any array size having equal numbers of rods 130 on a side may be used to form other numbers of quadrupoles.

The exit ends of the quadrupole rods 130 are fitted into bottom positioning cavities 140 in a bottom retainer plate 145 and extension tips 150 of the quadrupole rods 130 protrude through the bottom retainer plate 145 by means of transmission apertures 155 in the bottom positioning cavities 140. An ion optical grid 160 is aligned opposite the bottom retainer plate 145, preferably at a distance of 0.3 cm. Apertures 162 aligned with the axis of each quadrupole are formed in the grid 160. An ion deflector plate 165 is positioned at an angle, preferably 45 degrees, to the grid 160. A particle detector 170 is positioned with a detecting plate 175 parallel to the axis of symmetry of the QMSA 100.

Figure 3:
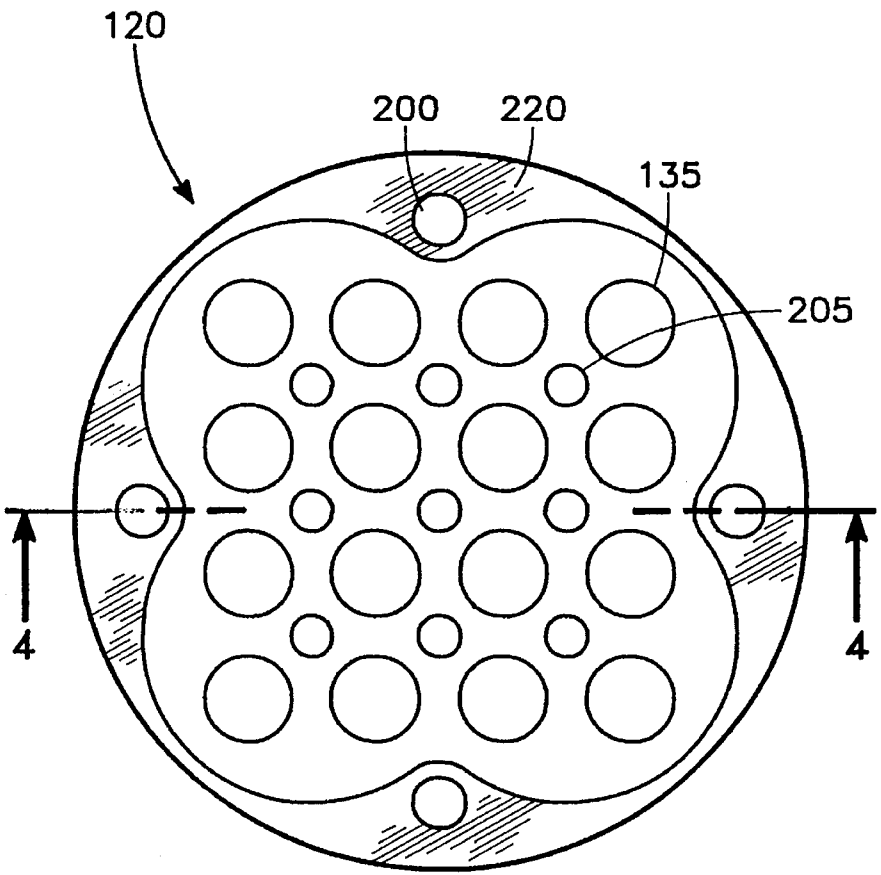
FIG. 3 is a bottom view of the top retainer plate of FIG. 2.
Figure 2:
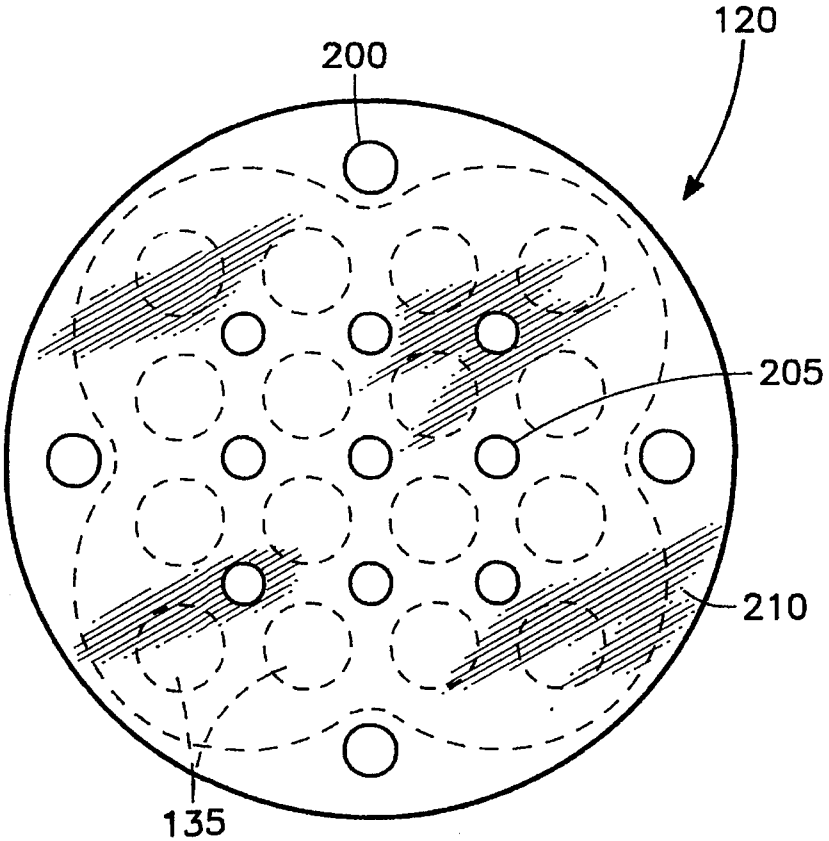
FIG. 2 is a top view of the top retainer plate of the QMSA of FIG. 1.

A top view of the top retainer plate 120 is shown in FIG. 2. Support holes 200 are formed at the periphery of the plate 120 and ion entrance apertures 205 are formed at midpoints between top positioning cavities 135 (shown in hidden line). A conductive layer 210 of any suitable conductor such as gold, titanium, or tungsten is deposited by conventional means, such as vapor deposition, over the entire top surface to a depth in the range of 5–20 microns. As shown in a bottom view of the top retainer plate 120 in FIG. 3, a similar conductive layer 220 connects only the support rod apertures 200 and is spaced apart from the array of top positioning cavities 135, preferably at a minimum distance of 0.05 cm. As shown in a cross section of the top retainer plate 120 in FIG. 4, conductive layers 210 and 220 are electrically connected by means of a conductive layer 230 deposited on the sides of apertures 205 and a conductive layer 240 deposited on the sides of apertures 200.

Figure 5:
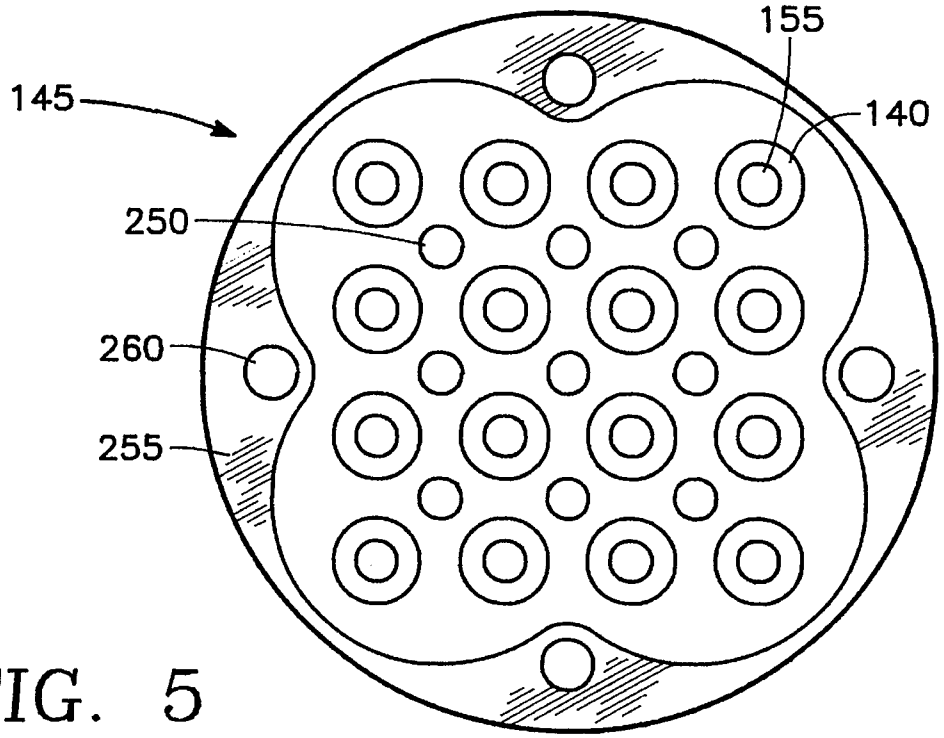
FIG. 5 is a top view of the bottom retainer plate of the QMSA of FIG. 1.

As shown in FIG. 5, ion exit apertures 250 are formed at midpoints between rod-positioning cavities 140 in the bottom retainer plate 145. A conductive layer 255 on the top of the bottom retainer plate 145 connects only the support rod holes 260 and is spaced apart from the array of bottom positioning cavities 140, preferably at a minimum distance of 0.05 cm.

Figure 6:
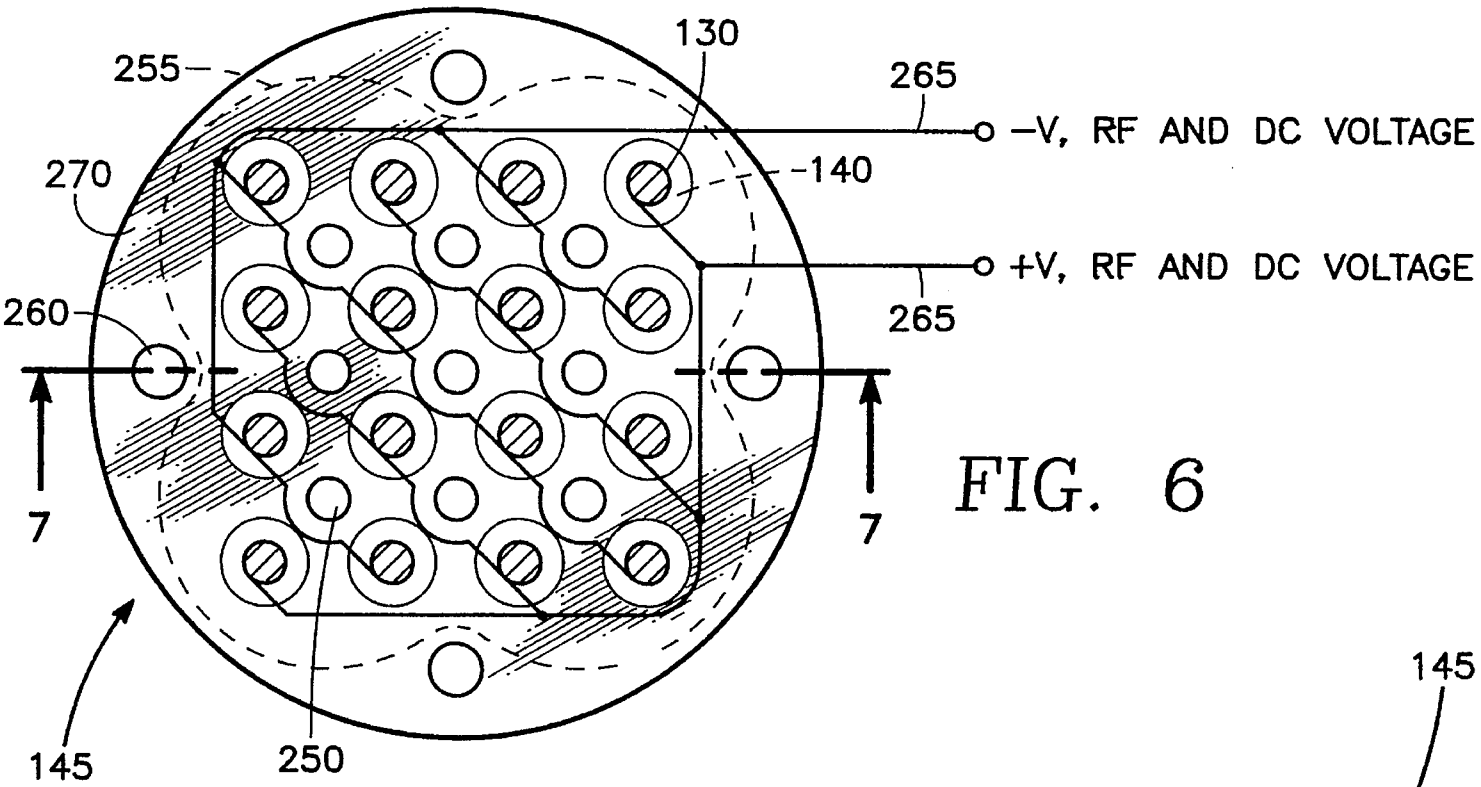
FIG. 6 is a bottom view of the bottom retainer plate of FIG. 5.

One method of electrically connecting the quadrupole rods 130 is shown in a bottom view of the bottom retainer plate 145 in FIG. 6. Diagonal rows of rods 130 are electrically connected by a means that will exert minimal stress on the rods 130 in order to maintain alignment. For example, spot welding of electrical leads has been used to minimize changes in alignment. Adjacent diagonal rows of rods 130 are connected by spot welding leads 265 to provide opposite dc and rf electric potential voltages. A conductive layer 270 is deposited over the entire bottom surface of the bottom retainer plate 145.

Figure 7:
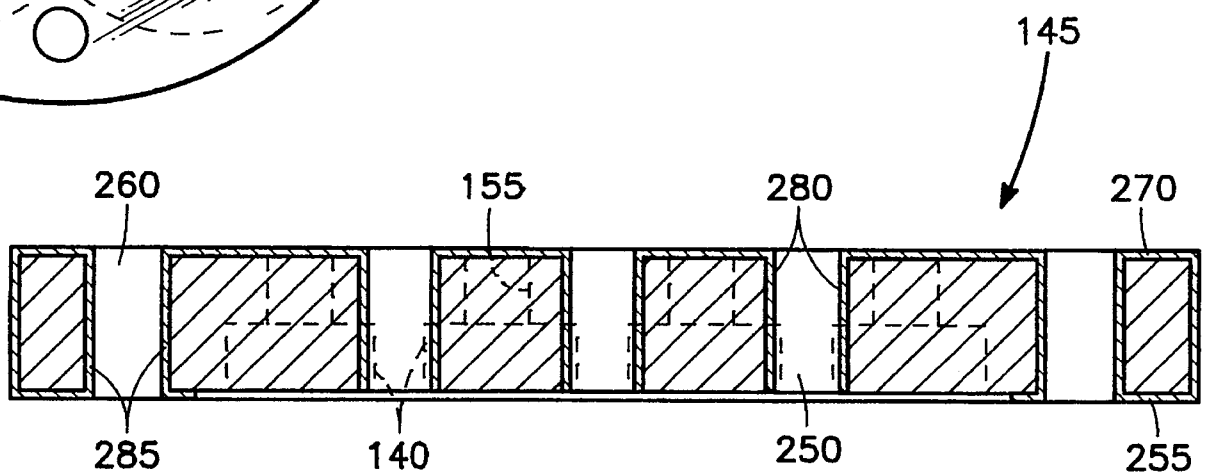
FIG. 7 is a cross section view of the bottom retainer plate of FIG. 5 along line 7—7.

As shown in FIG. 7, conductive layers 255 and 270 are electrically connected by means of a conductive layer 280 deposited on the sides of apertures 250 and a conductive layer 285 deposited on the sides of apertures 260.

Figure 4:
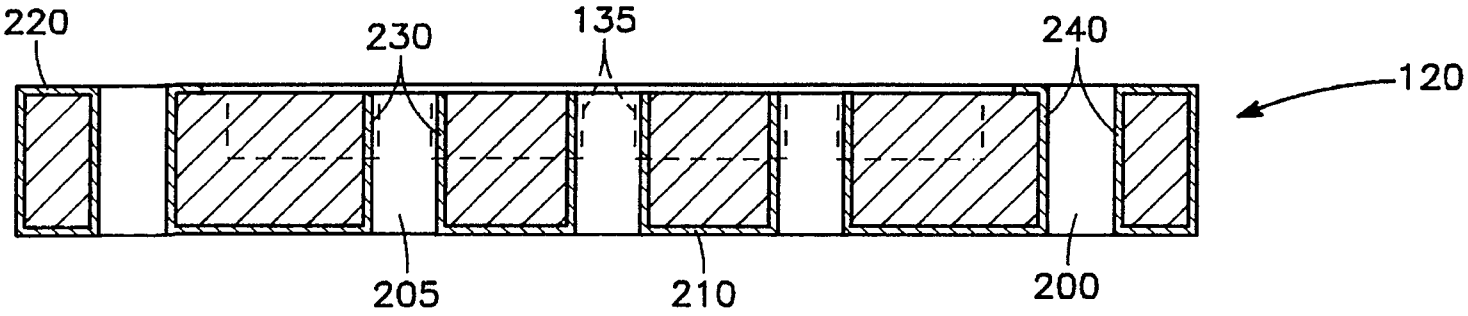
FIG. 4 is a side view of the top retainer plate of the QMSA of FIG. 1.

Referring to FIG. 1, operation of a QMSA 100 according to the invention begins by introduction of the gas to be analyzed through the gas inlet 105 and into the ionizer 110. Ions are attracted toward the top retainer plate 120 by a small electrostatic potential applied to the electrode 115, for example −10 volts. Referring to FIG. 2, ions either impact the conductive layer 210 or pass through apertures 205. Ions that impact the conductive layer 210 are neutralized at the surface of the layer 210. If the face of the top retainer plate 120 facing the ionizer 110 were not covered with the conducting layer 210, ions impacting the face would adsorb, creating localized fields and deflecting the trajectory of subsequent ions through the apertures 205, i.e, surface charging. Further, as shown in FIG. 4, the sides of apertures 205 and portions of the bottom side of top retainer plate 120 are also coated with conductive layers 230 and 220, respectively, for the same reason, i.e. to avoid surface charging that would deflect the motion of subsequent ions passing through apertures 205.

Ions that pass through apertures 205 move into the region of the quadrupole rods 130 (shown in FIG. 1), where the ions are separated by mass/charge ratio as described earlier. Ions of the mass selected by the applied rf voltage $V_o$ and dc voltage $U_o$ pass through apertures 250 in the bottom retainer plate 145 as shown in FIG. 5. Again, portions of the bottom retainer plate 145 are coated with a conductive material to avoid surface charging, including the conductive layer 255 on the top of the bottom retainer plate 145, the conductive layer 265 on the bottom of the bottom retainer plate 145 (shown in FIG. 6) and the conductive layer 280 on the sides of apertures 250 (shown in FIG. 7).

Alternating polarities of rf and dc voltages are applied to the ends of diagonal rows of quadrupole rods 130 as shown in FIG. 6, such as by spot welding wires to the ends of rods 130. Other suitable means may be used to impart the voltages to rods 130, but the means selected should not cause the rods 130 to move or impart a stress to the rods 130 that could cause movement, such as the springs used in the QMS made by Ferran. Any tendency to move the rods 130 imparted by the means to apply the electric potentials can result in misalignment of the rods 130 and reduce resolution of the QMSA.

After the selected ions pass through the apertures 250, they are focused by a conventional ion optical grid 160 (shown in FIG. 1) having an applied potential of approximately 100–200 dc volts. After focusing, the ion beam is deflected by the ion deflector plate 165 onto the particle detector 170, such as a Faraday cup, microchannel plate, or channeltron multiplier (made by Gallileo Electro-Optics Corporation, Sturbridge, Mass.), to detect the selected ions.

A QMSA according to the invention was tested using a standard electron-impact ionizer and an iridium filament for the ionization chamber 110. A channeltron multiplier was used as the particle detector 170 in conjunction with a computer interface module that produced a display of the relative intensity of the detector output versus ion mass. A scan of rf and dc voltages was performed to detect corresponding mass units. The rf voltage was varied from 0 to 1,000 volts at a frequency of 8 MHz, and the dc voltage was varied from 0 to 160 volts to sweep the QMSA over a mass range of from 0 to 100 amu. Greater rf voltages (up to 2000 volts) and dc voltages (up to 350 volts), and a range of rf frequencies (from 4 to 12 MHz) may be used to detect ions with a greater atomic mass.

Figure 8:
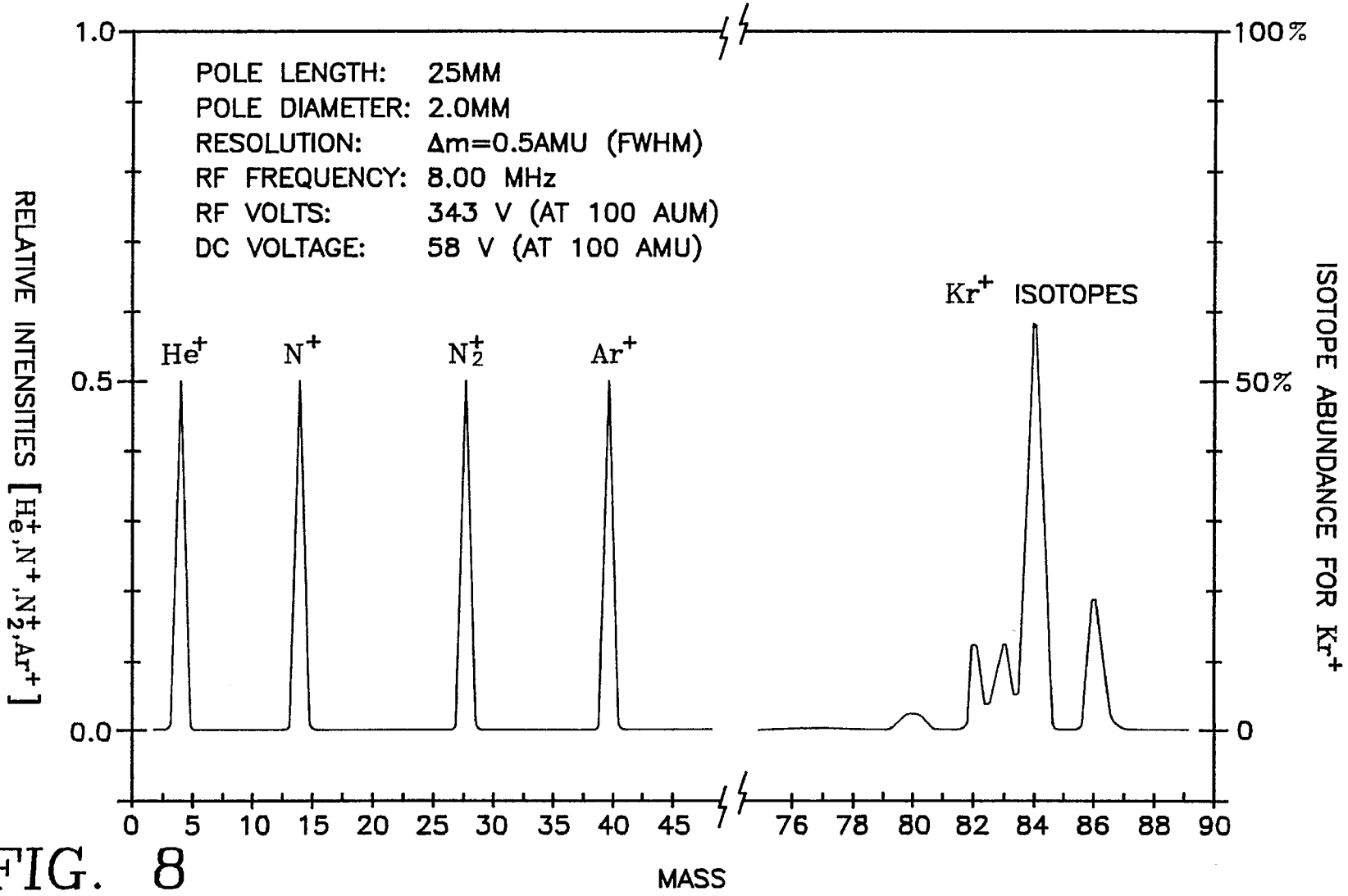
FIG. 8 is a graph of relative signal intensities of a QMSA of the invention versus atomic mass.

The resolution and sensitivity of the QMSA was directly measured from the digitized output. The digital measuring routine utilized the measurements around a single mass peak to calculate mass position and intensity. The output signal shown in FIG. 8 is helium (mass 4), nitrogen (mass 14), nitrogen molecule (mass 28), argon (mass 40) and several isotopes of krypton (maximum isotope abundance at mass 84) at a pressure of $1.0\times10^{-7}$ Torr. The full width at half maximum (FWHM) of these peaks is approximately 0.5 amu. Based on the data of FIG. 8 and the data reported by Boumsellek, et al. (1993), the QMSA of the invention exhibits the following substantial improvements in minimum detectable density (expressed in $cm^{-3}$) over the Ferran QMS:

| MINIMUM DETECTABLE DENSITY ($cm^{-3}$) | | |
|---|---|---|
| | QMSA of Invention | Ferran QMS |
| Neutral particles | $10^4$–$10^{12}$ | $10^{10}$–$10^{12}$ |
| Ions | 10–108 | $10^4$–$10^6$ |

As mentioned earlier, the number of quadrupoles can be increased by increasing the number of rods, to form a quadrupole array or QMSA. This has the effect of increasing the sensitivity and dynamic range of the QMS. A limit on improving performance in this manner is the physical size of the QMSA.

To summarize, a miniature QMSA of the invention achieved a mass resolution of 0.5 amu or better, which is accurate enough to make it a useful as a mass analyzer. Further, the sensitivity of the QMSA of the invention is 3 to 6 orders of magnitude greater than the previous Ferran QMS, which significantly extends the lower operating limits of a QMS. The QMS of the invention also exhibits a dynamic range of 5 to 6 orders of magnitude better than the Ferran device, which substantially extends the operational range of a QMS. These advantages result from novel features of the invention, including the use of top and bottom positioning plates to enhance rod alignment, conductive layers on the plates to avoid surface charging and electrical connections to the rods that reduce stress on the rods that introduces alignment error.

Although the present invention has been described with reference to preferred embodiments, workers skilled in the art will recognize that changes may be made in form and detail without departing from the spirit and scope of the invention.

What is claimed is:

1. A quadrupole mass analyzer for the separation of ions, comprising:

a first pair of parallel, planar, nonmagnetic conducting rods, each having an axis of symmetry;

a second pair of planar, nonmagnetic conducting rods each having an axis of symmetry parallel to said first pair of rods and disposed such that a line perpendicular to each of said first axes of symmetry and a line perpendicular to each of said second axes of symmetry bisect each other and from a generally 90 degree angle;

a nonconductive top positioning plate generally perpendicular to said first and second pairs of rods and having an aperture for ion entrance along an axis equidistant from each of said axes of symmetry;

a nonconductive bottom positioning plate generally parallel to said top positioning plate and having an aperture for ion exit centered on an axis equidistant from each of said axes of symmetry;

rigid and non-deforming means for maintaining a direct current voltage between said first and second pairs of rods; and rigid and non-deforming means for applying a radio frequency voltage to said first and second pairs of rods;

wherein said positioning plates further comprise means for preventing charging of exterior and interior surfaces of said plates.

2. The analyzer of claim 1 wherein said top positioning plate further comprises a conductive layer covering the interior surface of said aperture and a face of said top positioning plate opposite said rods.

3. The analyzer of claim 1 wherein said bottom positioning plate further comprises a conductive layer covering the interior surface of said aperture and a face of said bottom positioning plate opposite said rods.

4. The analyzer of claim 1 wherein said first and second pairs of rods have approximately equal lengths.

5. The analyzer of claim 4 wherein said equal length is no greater than approximately 2 cm.

6. The analyzer of claim 1 wherein said first and second pairs of rods have approximately equal radii.

7. The analyzer of claim 6 wherein said equal radius is no greater than approximately 0.1 cm.

8. The analyzer of claim 6 wherein the ratio between said radius and one-half the distance between surfaces of said pairs of rods is approximately 1.16.

9. The analyzer of claim 1 wherein the direct current voltage between said first and second pair of rods is in the range of more than 0 volts to approximately 350 volts.

10. The analyzer of claim 1 wherein the radio frequency voltage applied to said first and second pair of rods is in a frequency range of approximately 4 to 12 MHz.

11. The analyzer of claim 1 wherein the radio frequency voltage applied to said first and second pair of rods is in the range of more than 0 volts to approximately 2,000 volts.

12. The analyzer of claim 1 further comprising an electrode disposed adjacent a face of said top positioning plate opposite said rods and having an aperture along an axis equidistant from each axis of symmetry of each of said parallel rods.

13. The analyzer of claim 1 further comprising a grid disposed adjacent a face of said bottom positioning plate opposite said rods and having an aperture along an axis equidistant from each axis of symmetry of each of said parallel rods.

14. The analyzer of claim 13 further comprising an ion deflector plate disposed adjacent said grid opposite bottom positioning plate and at an angle to said grid.

15. The analyzer of claim 14 wherein said angle is approximately 45 degrees.

16. The analyzer of claim 1 wherein said means for maintaining a direct current voltage and said radio frequency means do not displace said rods.

17. The analyzer of claim 16 wherein said means for maintaining a direct current voltage and said radio frequency means comprise spot welds to maintain an electrical connection with said rods.

18. The analyzer of claim 1 further comprising a plurality of said first and second pairs of rods wherein a rod of each first pair comprises a rod of another first pair and a rod of each second pair comprises a rod of another second pair.

19. A quadrupole mass analyzer for the separation of ions, comprising:

a set of four parallel, nonmagnetic, conducting rods, each having an axis of symmetry, disposed such that coplanar lines connecting each said axis and intersecting only at said axes form a generally square figure;

a nonconductive top positioning plate generally perpendicular to said set of rods and having an aperture along an axis equidistant from each axis of symmetry of each of said parallel rods;

a nonconductive bottom positioning plate generally parallel to said top positioning plate and having an aperture centered on an axis equidistant from each axis of symmetry of each of said parallel rods;

rigid and non-deforming means for maintaining a direct current voltage between a first opposite pair of said rods and a second opposite pair of said rods; and rigid and non-deforming means for applying a radio frequency voltage to a first opposite pair of said rods and a second opposite pair of said rods;

wherein said positioning plates further comprise means for preventing charging of exterior and interior surfaces of said plates.

20. The analyzer of claim 19 wherein said top positioning plate further comprises a conductive layer covering the interior surface of said aperture and a face of said top positioning plate opposite said rods.

21. The analyzer of claim 19 wherein said bottom positioning plate further comprises a conductive layer covering the interior surface of said aperture and a face of said bottom positioning plate opposite said rods.

22. The analyzer of claim 19 wherein said means for maintaining a direct current voltage and said radio frequency means do not displace said rods.

23. The analyzer of claim 22 wherein said means for maintaining a direct current voltage and said radio frequency means comprise spot welds to maintain electrical connection with said rods.

* * * * *

UNITED STATES PATENT AND TRADEMARK OFFICE

CERTIFICATE OF CORRECTION

PATENT NO. : 5,596,193

DATED : January 21, 1997

INVENTOR(S) : Chutjian et al.

It is certified that error appears in the above-indentified patent and that said Letters Patent is hereby corrected as shown below:

In Column 5, line 54 please change "108" to --$10^8$--

Signed and Sealed this

Twenty-second Day of July, 1997

Bruce Lehman

*Attest:*

BRUCE LEHMAN

*Attesting Officer*

*Commissioner of Patents and Trademarks*